United States Patent [19]

Griffin

[11] Patent Number: 4,698,733

[45] Date of Patent: Oct. 6, 1987

[54] CLIP ON STAND OFF WIREWAY COVER

[75] Inventor: Alan R. Griffin, Thousand Oaks, Calif.

[73] Assignee: Thin-Lite Corporation, Camarillo, Calif.

[21] Appl. No.: 927,100

[22] Filed: Nov. 5, 1986

[51] Int. Cl.[4] ..... F21S 3/00

[52] U.S. Cl. ..... 362/222; 362/260

[58] Field of Search ..... 362/221, 222, 223, 217, 362/260

[56] References Cited

U.S. PATENT DOCUMENTS

| | | | |
|---|---|---|---|
| 2,090,239 | 8/1937 | Strang | 247/37 |
| 2,137,536 | 11/1938 | McConnell | 247/37 |
| 2,418,926 | 4/1947 | Francis | 240/78 |
| 2,516,660 | 7/1950 | Versen | 240/78 |
| 3,117,729 | 1/1964 | Silvers et al. | 362/222 |
| 3,187,660 | 6/1965 | Lazerson | 98/40 |
| 3,329,811 | 7/1967 | Schiffer et al. | 240/51.11 |
| 3,485,937 | 12/1969 | Caveney | 174/101 |
| 3,701,836 | 10/1972 | Ward et al. | 174/48 |
| 3,705,949 | 12/1972 | Weiss | 174/101 |
| 3,761,603 | 9/1973 | Hays et al. | 174/48 |
| 3,860,829 | 1/1975 | Fabbri | 362/221 |
| 3,890,459 | 6/1975 | Caveney | 174/68 |
| 4,246,629 | 1/1981 | Marrero | 362/147 |
| 4,464,707 | 8/1984 | Forrest | 362/222 |

*Primary Examiner*—Samuel Scott
*Assistant Examiner*—Noah Kamen
*Attorney, Agent, or Firm*—Fulwider, Patton, Rieber, Lee & Utecht

[57] ABSTRACT

A fluorescent lighting fixture including a channel-shaped housing formed with oppositely disposed elongated side walls projecting forwardly from a back wall and defining at their free extremities inwardly opening confronting grooves for receipt of the opposite sides of a lens. Mounted directed on the back wall at the opposite ends thereof are two pair of sockets for receiving the opposite ends of fluorescent tubes and arranged longitudinally between the confronting sockets are electrical components mounted from such back wall. Disposed on the lateral opposite sides of such components are shoulder rivets formed with rivet heads standing off from the back wall. A sheet metal way cover covers the electrical components and is hat shaped in cross-section and formed with outwardly turned flanges which clip under the respective rivet heads to releasably hold the way cover in its mounted position.

2 Claims, 5 Drawing Figures

FIG. 1
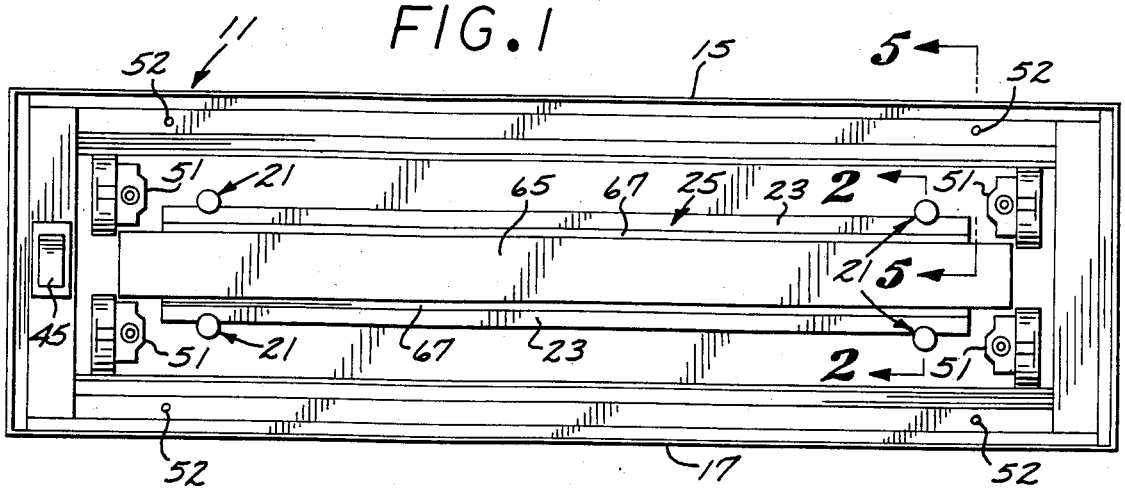
FIG. 2
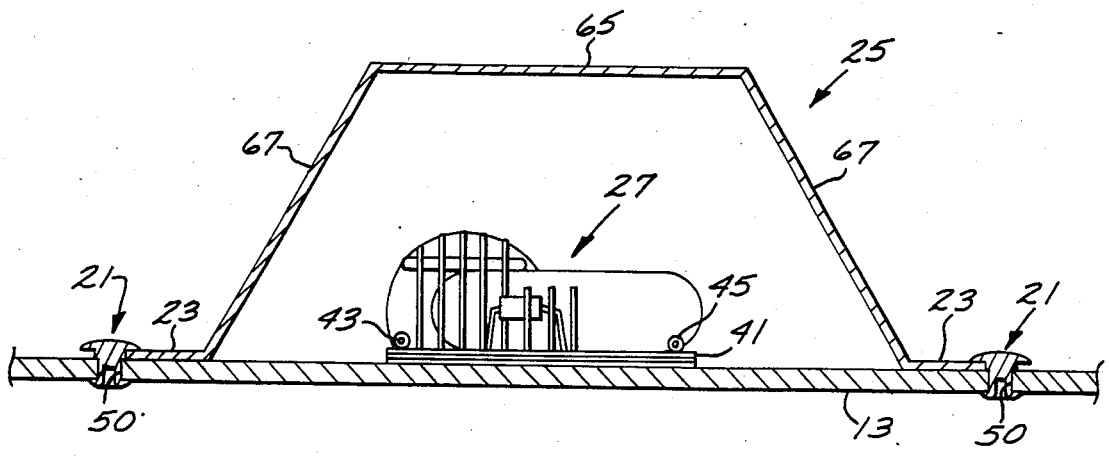
FIG. 3
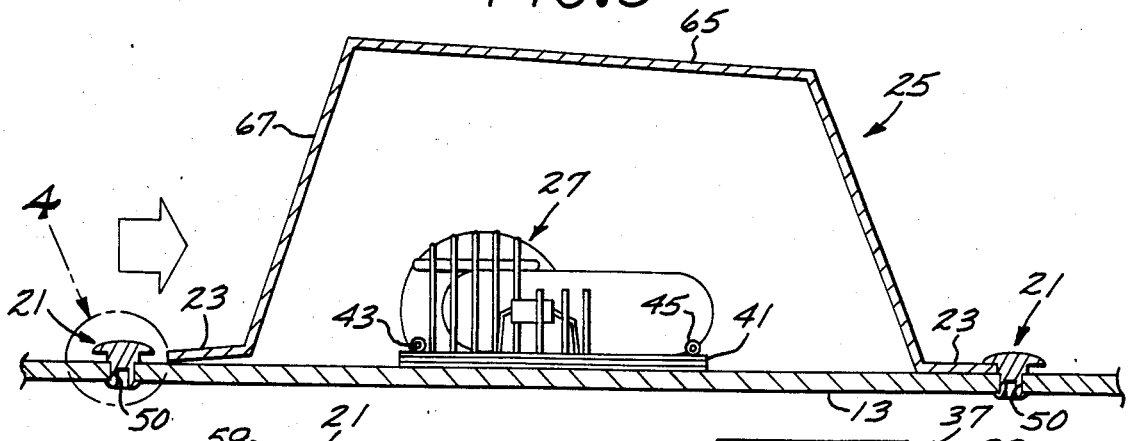
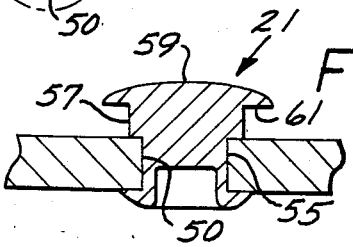
FIG. 4
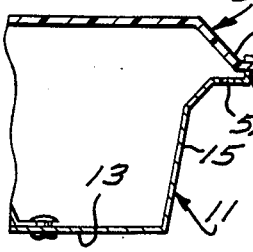
FIG. 5

CLIP ON STAND OFF WIREWAY COVER

BACKGROUND OF THE INVENTION

1. Field Of The Invention

The present invention relates to a fluorescent light fixture and more particularly to a fixture including a wiring wireway cover which is convenient to mount and dismount from the fixture itself.

2. Description of the Prior Art

In the construction of lighting fixtures and particularly fluorescent lighting fixtures adapted to mount electrical components for operating fluorescent light tubes from, for instance a DC source, it has been common practice to form such fixtures with a housing having a wireway cover mounted centrally thereon and concealed from view by an overlying lens. It has been common practice to mount such way covers from the fixture housing in a manner which will provide for mounting and dismounting thereof. This feature is important since safety restrictions promulgated by Underwriters Laboratories and others require that the fixture, when shipped from the manufacturer, have the way covers mounted on the fixtures.

In the past, it has been common practice to form such way covers of a generally elongated channel construction to mount over electrical components disposed centrally along the front face of the back wall of such fixtures and to then mount a stand off stud centrally from the back wall, such stud being formed at its forward extremity with a threaded bore for receipt of a fastening screw. A mating bore is then formed in the channel for passage therethrough of the fastening screw to be threaded into such threaded bore to reasonably maintain the channel in position.

Such prior art devices, while meeting safety requirements and serving their intended purposes, suffer the shortcoming that, for relatively inexpensive fixtures, the manufacturing costs are significant and the assembly procedure inconvenient and cumbersome. That is, the stand off stud itself is relatively expensive and the assembly technique, requiring a rivet gun or the like, is time consuming. Moreover, the procedure for mounting and dismounting the way cover requires a certain amount of dexterity and is, itself, time consuming. This factor is of importance since the way cover must be mounted at the factory for shipment and, typically, must then be dismounted to have access to the back wall for mounting purposes at the site of installation. After the housing has been mounted from the ceiling or wall of, for instance, a recreational vehicle, the way cover must then again be installed. This requires a certain amount of dexterity, particularly for relatively unskilled, do-it-yourselfers, who may be installing light fixtures for the first time. To mount the way cover from the fixture, either at the factory or upon installation of the fixture, it is necessary to position the way cover in overlying relationship with the electrical components, align the bore of the way cover with the threaded bore in the stand off stud, hold the way cover in position while manipulating the fastening screw into position projecting through the bore and the way cover to screw it into the threaded bore.

Efforts to overcome this shortcoming of the prior art have led to the development of extruded fixture housings which are formed in their back walls with longitudinally extending flanges formed with confronting spaced apart lips spaced from the back wall to form grooves for receipt therein of the opposed flanges of a flexible sheet metal way cover. However, such prior art devices suffer the shortcoming that, by its very nature, the extrusion technique leads to such flanges and grooves being formed the entire length of the housing thus creating a raised flange in the back wall where the fluorescent tube sockets are mounted. This then adds an additional step requiring the flanges to be machined off in the area where the sockets are to be mounted prior to assembly, thus adding prohibitively to the expense of manufacture. Thus, there exists a need for a light fixture housing and way cover combination which are inexpensive to manufacture and convenient to assemble and disassemble from one another.

SUMMARY OF THE INVENTION

The light fixture of the present invention is characterized by an extruded light housing formed with a planar back wall having oppositely disposed elongated side walls projecting forwardly therefrom and formed at their extremities with confronting inwardly opening grooves for receipt of the opposite sides of a light lens. Mounted at the opposite ends to such back wall are light sockets which receive the opposite ends of a fluorescent light. Mounted in the longitudinal central area of the back wall are electrical components which are covered by a way cover. The way cover is hat shaped in cross-section and is formed on the free extremities of its opposed side walls with outwardly turned flanges which are releasably hooked under the heads of shoulder rivets mounted in such back wall to releasably hold the way cover in position.

Other objects and features of the invention will become apparent from consideration of the following description taken in connection with the accompanying drawings.

BRIEF DESCRIPTION OF THE DRAWINGS

FIG. 1 is a bottom plan view showing a fluorescent light fixture embodying the present invention;

FIG. 2 is a partial transverse sectional view, in enlarged scale, taken along the line 2—2 of FIG. 1;

FIG. 3 is a transverse sectional view similar to FIG. 2 but showing the way cover being removed;

FIG. 4 is a detail view, in enlarged scale, taken from the circle designated 4 in FIG. 3; and FIG. 5 is a sectional view, in enlarged scale, taken along the line 5—5 of FIG. 1.

DESCRIPTION OF THE PREFERRED EMBODIMENT

The fluorescent tube lighting fixture of the present invention includes, generally, an extruded housing 11 formed with a back wall 13 and oppositely disposed side walls 15 and 17. Mounted in spaced apart relation from the back wall are four shoulder rivets 21 located at the corners of an imaginary rectangle and which removably receive the oppositely projecting mounting flanges 23 of a way cover, generally designated 25, which covers an electrical raceway mounting an electrical assembly, generally designated 27. Referring to FIGS. 1 and 5 in greater detail, the housing 11 is in the form of an elongated channel with the walls 15 defining the opposites sides of the channel and then being turned laterally outwardly at their free extremities and then upwardly to form side flanges 31. The side flanges 31 are formed on their inner sides with respective confronting grooves 33. The confronting grooves 33 are in alignment with one another to receive the opposite flanges 35 of a lens cover, generally designated 37, which serves to cover the front of the housing and to defuse light emitted therefrom while obscuring view of the housing itself.

The back wall 13 of the housing 11 is planar and has mounted centrally thereon an elongated longitudinal circuit board or pad 41 which mounts the electrical components 27. The electrical components 27 typically include the components for powering the electric lights (not shown) mounted in the housing. Electrical leads 43 and 45 may then run the length of the housing 11 and be connected on one end thereof with an on/off switch 45.

The fluorescent tube lighting fixture in the preferred embodiment is intended to mount a pair of elongated fluorescent tubes. For this purpose, electrical sockets 51 are mounted at the opposite ends of the housing in paired alignment for receipt therebetween of respective fluorescent tubes (not shown). The light sockets 51 are of conventional construction and are formed with flat bases which abut directly against the planar front surface of the back wall 13 and may be riveted directly thereto. With their flat mounting base and direct riveting to the back wall 13, the expense of assembly is held at a minimum.

The back wall 13 is formed with four through bores 5 (FIG. 3) for receipt of the shoulder rivets 21, such bores being spaced laterally apart on the opposite side of the area defined by longitudinal extension of the electrical mounting pad 41. The shoulder rivets 21 are commercially available and are formed with respective stems 55 (FIG. 4) received in the bores 5 and are then enlarged in diameter to form respective shanks 57 which terminate at their forward extremities with respective rivet heads 59. The heads 59 form respective shoulders 61 spaced from the front face of the back wall 13 a distance sufficient for receipt of the opposed flanges 23 defined by the opposite edges of the wireway cover 25. The back end of the respective rivets 21 are riveted over to hold them securely in position.

The housing 11 itself is constructed of extruded aluminum which may be cut to length in an assembly line procedure. Bores or holes for the mounting rivets for the light sockets 51, electrical mounting plate 41, shoulder rivets 21 and bores 52 (FIG. 5) for recessed mounting may all be then punched or drilled at the same time.

The wireway cover 25 is hat shaped in cross-section to form a front wall 65, outwardly and rearwardly diverging side walls 67 which terminate at their extremities in the laterally outwardly projecting mounting flanges 23. The wireway cover 25 is constructed of sheet metal and has sufficient flexibility to enable to the walls 67 to flex sufficiently for the flanges 23 to be disengaged from underneath the heads 59 of the rivets 21 as shown in FIG. 3.

In operation, the fixture is typically fully assembled at the manufacturing plant with the electrical plate 41 riveted or mounted to the back wall 13 and the light sockets 51 riveted in place.

The shoulder rivets 21 may be quickly and easily riveted in position by feeding the housing through an automatic riveting machine which automatically feeds the rivets into their respective bores and rivets them in position. The wireway cover 25 is mounted by positioning it on the electrical assembly 27 and merely engaging one flange 23 under the shoulder 61 of one pair of rivets 21 at one side of the wiring raceway and flexing the side walls 67 sufficiently to collapse the free extremities thereof toward one another a distance sufficient to enable the projected edge of the opposite flange 23 to clear the rivet heads 59 on that side of the housing and the wall 67. The walls 67 of the wireway cover 25 are then released to enable the flange 23 to be driven outwardly under the influence of the resiliant walls 67 to engage the opposed shoulder rivets. The lens 37 may then be snapped into position and the unit is ready for shipping to the retail outlet.

When the installer, or end user, installs the fixture, he or she may cut a rectangular hole to enable the housing to be recessed with the opposed flanges 31 coming to rest against the support structure, such as a ceiling or wallboard. It will be appreciated that the lens 37 and wireway cover 25 may be conveniently removed during the procedure. Mounting screws may then be inserted through the bores 52 (FIG. 5) to mount the housing 11 in position.

The wireway cover 25 may then be reinserted in the same manner that it was during original assembly and the lens 37 snapped back into position. The light is then ready for use.

In other applications, when it is desirable to mount the housing directly with the back wall 13 directly supported from the mounting structure, bores may be formed in such back wall and the mounting screws inserted therethrough. The mounting procedure is greatly facilitated by the capability of convenient removal and remounting of the wireway cover 25.

It will be appreciated that with the lighting fixture of the present invention, the technique for removing the wireway cover 25 is extremely simple, requiring little skill, experience or dexterity. The way cover may thus be mounted and dismounted with a minimum of effort and with little danger of such cover being remounted in an improper manner.

Various modifications and changes may be made with regard to the foregoing detailed description without departing from the spirit of the invention.

I claim:

1. A fluorescent tube lighting fixture comprising:

an elongated, relatively thick extruded channel shaped housing formed with a back wall defining a planar mounting plate having a flat front side including a longitudinal central area defining a raceway, said housing further including coextensive oppositely disposed side walls projecting from the opposite sides of said flat front side of said back wall and formed at their free ends with inwardly opening confronting slots, said housing being further formed with mounting holes for receipt of mounting screws to mount said housing directly from a support surface;

fluorescent tube sockets mounted in alignment with one another directly on said back wall at the opposite ends of said housing for receipt therein of the opposite ends of fluorescent light tubes;

electrical components mounted in said raceway;

through bores formed on the lateral opposite sides of said raceway intermediate said raceway and said sidewalls;

shoulder rivets formed centrally with respective stems projecting through said bores and further formed on the front sides with enlarged in diameter shanks defining respective rearwardly facing annular surfaces and projecting from the front side of said back plate and terminating in respective rivet heads defining rearwardly facing shoulders spaced a predetermined distance from said front wall, said stems being rolled over on the back side of said back wall to cooperate with said respective annular surfaces to sandwich the thickness of said back wall therebetween;

an elongated relatively thin way cover for covering said electrical components formed in cross section with a hat shape to define a front wall and oppositely disposed side walls projecting rearwardly therefrom and turned outwardly away from one another at their free extremities to form respective flanges having a thickness less than said predetermined distance;

said way cover being so configured as to fit over said electrical components with said flanges received between the said shoulders of the respective rivets and front of said back wall, said side walls being flexible and resilient to normally hold said flanges spaced apart with sufficient force to maintain them engaged under said shoulders while permitting said side walls to be manually flexed inwardly a sufficient distance to carry said flanges inwardly toward one another a distance sufficient to clear said rivet heads whereby mounting screws may be inserted through said mounting holes to mount said housing directly from a mounting surface and said way cover may be mounted and dismounted from said housing by manually flexing said free ends of such way cover side walls inwardly to clear the respective shoulders.

2. A fluorescent tube lighting fixture as set forth in claim 1 for mounting a pair of fluorescent lighting tubes and that includes:

two pairs of lights sockets mounted in confronting relationship at the opposite ends of said housing and on opposite sides of said raceway.

* * * * *